US011779974B2

(12) United States Patent
Traub

(10) Patent No.: US 11,779,974 B2
(45) Date of Patent: Oct. 10, 2023

(54) PROFILE STRAIGHTENING APPARATUS FOR A PROFILING SYSTEM

(71) Applicant: Dreistern GmbH & Co. KG, Schopfheim (DE)

(72) Inventor: Tilman Traub, Neuenburg (DE)

(73) Assignee: Dreistern GmbH & Co. KG, Schopfheim (DE)

( * ) Notice: Subject to any disclaimer, the term of this patent is extended or adjusted under 35 U.S.C. 154(b) by 117 days.

(21) Appl. No.: 16/941,805

(22) Filed: Jul. 29, 2020

(65) Prior Publication Data

US 2021/0053098 A1 Feb. 25, 2021

(30) Foreign Application Priority Data

Aug. 22, 2019 (EP) ..... 19193157

(51) Int. Cl.
*B21B 38/02* (2006.01)
*B21B 37/40* (2006.01)

(52) U.S. Cl.
CPC ..... *B21B 37/40* (2013.01); *B21B 38/02* (2013.01)

(58) Field of Classification Search
CPC ..... B21B 2265/12; B21B 2273/04; B21B 2275/12; B21B 37/58; B21B 37/78; B21B 37/08; B21B 37/60; B21D 3/02; B21D 3/05; B21D 7/08
See application file for complete search history.

(56) References Cited

U.S. PATENT DOCUMENTS 5,806,357 A * 9/1998 Bouchillon ..... B21B 37/52 72/10.2
6,279,363 B1 8/2001 Auerbach et al.
2011/0056649 A1* 3/2011 Hohenbichler .... B22D 11/1206 164/460
2014/0007637 A1* 1/2014 Hayashi ..... B21B 37/28 72/200

FOREIGN PATENT DOCUMENTS

EP 1036915 9/2000
JP 2003154410 5/2003

* cited by examiner

*Primary Examiner* — Bobby Yeonjin Kim
(74) *Attorney, Agent, or Firm* — Volpe Koenig P.C.

(57) ABSTRACT

A profile straightening apparatus 5 for a profiling system which is used to produce a metal profile 4 by roll profiling along a longitudinal axis of the metal profile. The profile straightening apparatus is intended for correcting axial deviations of the metal profile from a prescribed profile geometry, and includes a frame 8 and having at least two interacting correction rollers 6, 7, which are mounted in the frame, receive the metal profile between them and, in relation to the longitudinal axis of the metal profile, are adjustable in two radial directions and also in at least one direction of rotation. The profile straightening apparatus is equipped with force measuring sensors for any forces $F_y$, $F_z$ acting in the metal profile in one or both radial directions and for any torques $M_x$ acting in the metal profile in a direction of rotation about the longitudinal axis.

15 Claims, 4 Drawing Sheets

PROFILE STRAIGHTENING APPARATUS FOR A PROFILING SYSTEM

INCORPORATION BY REFERENCE

The following documents are incorporated herein by reference as if fully set forth: European Patent Application No. 19193157.5, filed Aug. 22, 2019.

TECHNICAL FIELD

The invention relates to a profile straightening apparatus with said profile straightening apparatus being configured for use in a profiling system, with which a metal profile is produced by means of roll profiling along a longitudinal axis of the metal profile.

Such a profile straightening apparatus is intended for correcting axial deviations of the metal profile from a prescribed profile geometry. It comprises a frame, through which the metal profile passes, and at least two interacting correction rollers, which are mounted in the frame, receive the metal profile between them and, in relation to the longitudinal axis of the metal profile, are adjustable in two radial directions and also in a direction of rotation.

The invention also relates to a method for correcting axial deviations of a metal profile from a prescribed profile geometry in a profiling system using such a profile straightening apparatus.

BACKGROUND

A profiling system generally manufactures profiles of very different cross-sectional forms in a virtually endless manner from a metal strip, the designation "profile" being intended here to also include tubes. Depending on the profile form, a multiplicity of roll forming tools are used for this purpose, which are combined in groups in typically 20 to 30 forming stations, which are arranged in linear succession, and successively form the desired metal profile by means of stepwise cold forming. The starting material is usually a metal strip but can also be plates or already preformed starting profiles, which are formed in the profiling system to give a desired profile. Before, between or after the forming stations, profiling systems usually have further machining stations, such as, for example, devices for introducing openings or bends into the profile, calibrating devices, welding devices or a separating device for cutting the virtually endlessly produced profile to length into profile pieces which represent the end product of the profiling system.

Particularly in the case of asymmetric profile geometries, but also, due to the system, in the case of most symmetric profile geometries, longitudinal strains, which are distributed inhomogeneously over the cross section, occur in the material during forming of the profile in the individual forming stations. Especially if said longitudinal strains result in permanent elongation or compression of individual profile portions, deviations of the profile geometry along the longitudinal axis of the metal profile may subsequently occur, such as, for example, a torsion of the metal profile or longitudinally proceeding deviations from the longitudinal axis, due to which the metal profile is as a result not formed as straight but rather as slightly bent.

To correct such undesired shape deviations along the longitudinal axis, that is to say such axial deviations of the metal profile from the prescribed profile geometry, it is known to fit a profile straightening apparatus of the present type in the profiling system. Due to the correction rollers of said profile straightening apparatus, which receive between them the metal profile which is passing through the frame and upstream and/or downstream of the profile straightening apparatus is clamped in forming stations, the metal profile can be axially bent or twisted by adjusting the correction rollers in radial directions, which are preferably orthogonal to each other and are usually the horizontal and the vertical, and/or in a direction of rotation about the longitudinal axis of the metal profile. With such axial bending or torsion, which is introduced into the metal profile by the profile straightening apparatus, it is possible to counteract an aforementioned axial deviation of the profile geometry, in order to ensure that the profiling result is a straight metal profile piece without bowing or twisting.

Known profile straightening apparatuses are set by experienced operating personnel of a profiling system. If during run-in of the profiling system it appears that the work result with regard to any axial deviations of the metal profile from the prescribed profile geometry is not optimal, or if during ongoing operation of the profiling system it is found that such axial deviations occur or increase, the operating personnel counteract said deviations by adjusting the correction rollers of the profile straightening apparatus in order to introduce axial bends or a torsion into the metal profile, which counteract the previously determined deviation.

It is obvious that this procedure requires experienced operating personnel and there is nevertheless the risk that the correction of determined deviations is only accomplished in several successive steps, during which waste is produced.

SUMMARY

The invention is therefore based on the object of providing a profile straightening apparatus for correcting axial deviations of the metal profile from a prescribed profile geometry, and also a corresponding method using said profile straightening apparatus, with which it is possible to at least substantially automatically identify imminent axial deviations of the metal profile from the prescribed profile geometry, such that the operating personnel are assisted and less waste is produced, and also it is possible if necessary to perform an automated correction of the axial deviations.

This object is achieved by a profile straightening apparatus having one or more of the features described herein. Preferred configurations of the profile straightening apparatus are found in the claims. Furthermore, said object is achieved by a method having one or more of the features described herein, with advantageous developments of said method being found in the claims.

According to the invention, a profile straightening apparatus, which, as described in the introduction, comprises a frame with adjustable correction rollers for the metal profile, is correspondingly equipped with force measuring sensors for any forces acting on the metal profile in radial directions, that is to say in directions orthogonal to the longitudinal axis of the metal profile, and for any torques acting on the metal profile in a direction of rotation about the longitudinal axis. Force measuring sensors in the context of the present invention are sensors which can detect forces and/or torques and in particular measure the magnitudes thereof. With such force measuring sensors it is possible to identify stresses in the material already at the location of the profile straightening apparatus, said stresses leading as a result to the undesired axial deviations of the metal profile from the prescribed profile geometry. It is therefore not necessary to wait to see what the metal profile looks like at the output of the profiling system before countermeasures can be taken at the profile straightening apparatus—which naturally produces corresponding waste due to the associated dead time in the control loop.

The invention is thus based on a fundamental departure from the previous procedure, in which the metal profile piece present as an end product at the output of the profiling system was examined for axial geometry deviations, and any axial deviations from the prescribed profile geometry (bowed form, twists) were taken as a basis for adjusting the correction rollers in the profile straightening apparatus in order to introduce deliberate axial bends or torsions into the metal profile, which compensate for the determined axial deviations. According to the invention, it is not the case that the geometry of the metal profile is only examined at the output of the profiling system, but rather that a force measurement is already carried out beforehand in the region of the profile straightening apparatus in order to be able to identify if internal stresses, which lead to the undesired axial shape deviations, exist in the material. In this way, far more rapid feedback between an adjustment of the profile straightening apparatus and the compensation results obtained thereby is possible. In particular, it is possible to identify imminent shape deviations of the metal profile already at a point at which said shape deviations can be counteracted. It is apparent that this makes it possible to reduce the production of waste quite decisively.

A further advantage of the force measurement according to the invention consists in that any increasing tendencies of the profiling system to produce metal profiles with axial shape deviations can be identified by the continuous force or torque monitoring and possibly indicated with an alarm signal, specifically before waste is produced. Such increasing tendencies for an axial shape deviation sometimes result from wear of the roll forming tools, as a result of any adjustments at individual forming stations or due to any material fluctuations, such as internal stresses in the metal strip which is formed to give the metal profile, or thickness fluctuations of the material. Axial shape deviations cannot always be identified with the required accuracy with the naked eye, and so there have certainly been cases in the prior art where a relatively large amount of waste has been produced before it became apparent that the produced metal profiles have axial shape deviations outside of the prescribed tolerances.

Even continuous automated monitoring of the geometric form of the metal profiles at the output of the profiling system cannot prevent possible countermeasures by the profile straightening apparatus only ever being effective after the event or with a time delay, that is to say that here, too, waste is produced; if several iterations are necessary when correcting axial deviations of the metal profile, said waste is multiplied correspondingly.

Particular advantages arise if, as is preferred in the context of the present invention, the correction rollers of the profile straightening apparatus is adjustable in a motorized manner by adjustment drives and a controller is present, which is operatively connected to the force measuring sensors and actuates the adjustment drives. With this preferred variant of the invention it is possible to automate the correction of axial shape deviations of the metal profile. This not only saves costs, because the experienced personnel required hitherto no longer have to be provided, but it also becomes possible, due to the measured forces and torques, to generate corresponding counterforces or counter torques by adjusting the correction rollers on the basis of calculations performed in the controller. This not only replaces the experience of the experienced personnel but can also lead more rapidly to the desired goal. This is because, with corresponding algorithms, trial and error iterations are at least substantially superfluous.

Motor-adjustable correction rollers of the profile straightening apparatus according to the invention make it possible, in a particularly simple manner, for the first time to not only identify (by the force measuring sensors such as strain gauges or load cells) arising or increasing tendencies toward axial shape deviations of the metal profile but also compensate for them instantaneously.

The equipping of a profile straightening apparatus with force measuring sensors according to the invention, with or without motorized adjustment drives for the correction rollers, leads to a self-contained system which can be integrated in already existing profiling systems without a large amount of adaptation work, that is to say that the profile straightening apparatus according to the invention is advantageously also suitable for retrofitting already existing profiling systems.

In particular, a profile straightening apparatus according to the invention with motorized adjustment of the correction rollers and with a controller for the adjustment drives can additionally be operatively connected to a measuring station for recording the longitudinal profile geometry of the metal profile at the output of the profiling system, that is to say that, in order to calculate adjustments of the correction rollers that are necessary for the correction of any axial shape deviations, the geometric measurement values of the measuring station can also be used in addition to the forces or torques measured by the force measuring sensors in order, for example, to continuously optimize the calculations and/or to perform additional adjustments of the correction rollers if the measuring station for instance continues to detect axial deviations from the prescribed profile geometry.

Here, the controller can be programmed with an algorithm in such a way that it combines geometric data obtained by the measuring station with the magnitudes of the forces and/or torques ascertained by the force measuring sensors in order to identify relationships between the ascertained magnitudes of the forces and torques and the geometric data of the same profile portion, and also relationships between changes in the ascertained magnitudes of the forces and torques and changes in the geometric data of the same profile portion, and takes said relationships into account during the control of the adjustment drives, and in particular uses said relationships in the sense of machine learning for the continual optimization of the algorithm.

The correction rollers of the profile straightening apparatus according to the invention are preferably adjusted while maintaining their positions assumed relative to one another, since said rollers are intended to act on the metal profile as a whole, without influencing the profile cross section.

Upstream and/or downstream of the correction rollers, guide rollers for guiding the metal profile passing through may be provided axially at a distance from said correction rollers. With such guide rollers, the metal profile can be bent and/or twisted in the profile straightening apparatus, without needing to also include an adjacent forming station as a zero position of the metal profile. This not only enables substantially autonomous operation of the profile straightening apparatus but also makes it possible to ensure reproducible boundary conditions during the force and torque measurement—the latter could be problematic depending on the type of an adjacent forming station.

Here, the force measuring sensors can be at least partially arranged in the region of the guide rollers. If the guide rollers are located upstream of the correction rollers in relation to a direction of movement of the metal profile, this optimizes the above-described advantages of the possibility of correction without dead time, that is to say without producing waste.

However, in the context of the present invention, it is preferred for the force measuring sensors to be at least partially arranged on the correction rollers, on the bearings thereof in the frame and/or on the adjustment mechanism for the correction rollers. In particular, it is possible to identify increasing tendencies for an axial shape deviation of the metal profile in an optimal manner at this location.

The methods according to the invention for correcting axial deviations of a metal profile from a prescribed profile geometry in a profiling system essentially include using a profile straightening apparatus according to the invention in order to correct axial deviations of the metal profile.

However, the first method according to the invention is not confined to identifying increasing tendencies of axial deviations as a result of wear, material fluctuations or setting work at individual forming stations, but is intended to also assist the setting-up of the profile straightening apparatus: the metal profile is initially moved into the profile straightening apparatus, which is integrated in the profiling system or is connected downstream thereof and which is located in a zero position. Before it reaches a machining station which may be arranged downstream of the profile straightening apparatus, any radial forces and/or any torques in the metal profile are ascertained by means of the force measuring sensors, and adjustment values for an adjustment of the correction rollers in one or both radial directions and/or in a direction of rotation are calculated therefrom, to be used for the correction rollers to be adjusted in order to correct imminent axial deviations of the metal profile from the prescribed profile geometry. Preferably, the profile is stopped in the profile straightening apparatus for the initial measurements. Proceeding from said first determined adjustment values, during the further operation of the installation, changes in the acting forces/torques are recorded and changed profile geometries are inferred therefrom. On this basis, target values for a continuous readjustment of the straightening apparatus are continually determined.

In the second method according to the invention, a profile straightening apparatus which has adjustment drives for the motorized adjustment of the correction rollers and also a controller for the adjustment drives is used. The force measuring sensors input any ascertained forces and/or torques into the controller of the profile straightening apparatus, the controller calculates adjustment values therefrom for an adjustment of the correction rollers in one or both radial directions (usually horizontally and vertically) and/or in a direction of rotation and actuates the adjustment drives in order to adjust the correction rollers in accordance with the adjustment values.

If, during set-up operation of the profiling system, the profile straightening apparatus is conventionally set by hand in order to manufacture profile pieces without axial deviations from the provided profile geometry, changes in the measured forces or torques are transmitted to the controller, in which a suitable algorithm is used to calculate how the correction rollers, possibly taking account of a threshold value for the detected changes, need to be further adjusted radially, in particular vertically and/or horizontally, and/or rotated about the longitudinal axis of the metal profile in order to neutralize the changed internal stresses acting in the metal profile or counteract them such that undesired axial deviations from a prescribed profile geometry are corrected. The controller uses the corresponding results to actuate the adjustment drives of the profile straightening apparatus and to adjust the correction rollers correspondingly.

As an alternative, the controller can also output handling instructions to operating personnel for the manual adjustment of the correction rollers, said personnel then acting as actuator instead of the actuating drives. With this alternative, a profile straightening apparatus without adjustment drives can also be used.

As an advantageous configuration of said method according to the invention, a measuring station for the geometric measurement of the metal profile is arranged downstream of the profile straightening apparatus, with any axial deviations of the metal profile from the prescribed profile geometry being identified in said measuring station. In this case, the adjustment values, calculated from the measured forces or torques, for an adjustment of the correction rollers in order to correct axial deviations of the metal profile from the prescribed profile geometry can be checked on the basis of the geometric measurement data of the measuring station and possibly corrected or optimized. This preferably takes place by means of corresponding correction values upon calculation of the adjustment values for the correction rollers.

A self-learning algorithm can also be used for calculating the adjustment values, said algorithm optimizing itself on the basis of the geometric measurement data of the measuring station and thus also being able to undertake the set-up operation, for example after a corresponding learning phase. To this end, geometric data obtained by the measuring station can in particular be combined with the magnitudes of the forces and/or torques ascertained by the force measuring sensors in order to identify relationships between the ascertained magnitudes of the forces and torques and the geometric data of the same profile portion, and also relationships between changes in the ascertained magnitudes of the forces and torques and changes in the geometric data of the same profile portion, and for said relationships to be taken into account during the control of the adjustment drives.

BRIEF DESCRIPTION OF THE DRAWINGS

One exemplary embodiment of a profile straightening apparatus configured according to the invention and the correction method carried out therewith is described and explained in greater detail below with reference to the attached drawings, in which.

DETAILED DESCRIPTION

Figure 1:
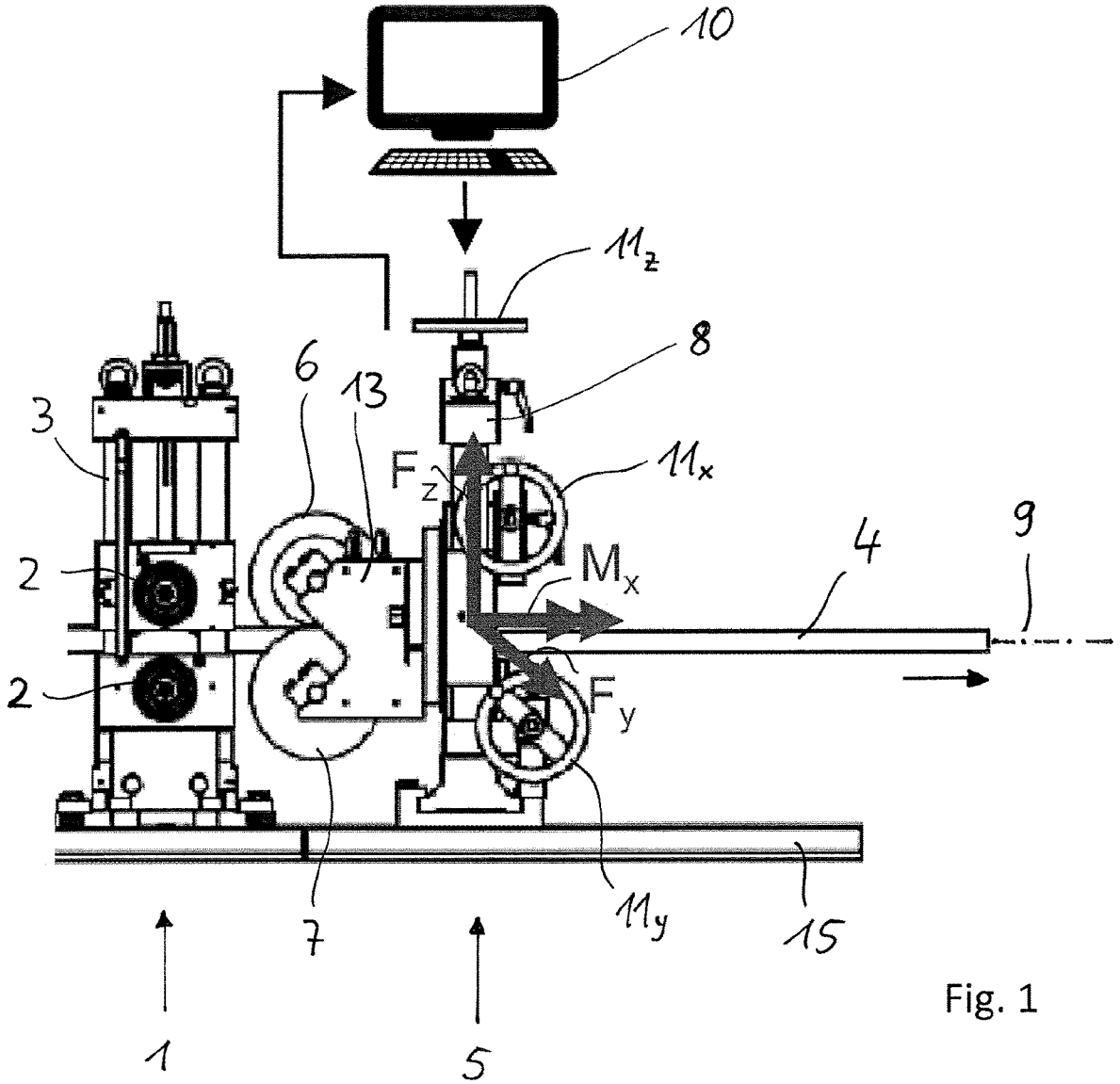
FIG. 1 shows one exemplary embodiment of a profile straightening apparatus configured according to the invention in the installed state in a profiling system.

FIG. 1 shows a schematic illustration of a detail from a profiling system with a multiplicity of forming stations 1 (of which only one is illustrated for reasons of better clarity) with roll forming tools 2, which are mounted in a framework 3 and which act on a metal profile 4 passing through—or at first a metal strip. A profile straightening apparatus 5 integrated in said profiling system is arranged directly downstream of the forming station 1 illustrated here and comprises a frame 8 with an upper 6 and a lower correction roller 7, said rollers receiving between them the metal profile 4 passing through the frame 8. As indicated by means of arrows $F_z$, $F_y$ and $M_x$, in the frame 8 of the profile straightening apparatus 5 there are arranged force measuring sensors (not directly visible) with which any forces and torques can be measured, specifically, in relation to a longitudinal axis 9 of the metal profile 4, radial forces, that is to say forces acting transversely with respect to the longitudinal axis 9, in the horizontal direction ($F_y$) and in the vertical direction ($F_z$) and also torques ($M_x$) which act about the longitudinal axis 9. The force measuring sensors input the measurement values into a controller 10, which, for its part, actuates adjustment drives $\mathbf{11}_x$, $\mathbf{11}_y$ and $\mathbf{11}_z$ which are symbolized here by hand cranks. By means of the adjustment drives $\mathbf{11}_x$, $\mathbf{11}_y$, $\mathbf{11}_z$, the correction rollers 6, 7 can be adjusted, with their position assumed relative to one another remaining unchanged, in the vertical and/or horizontal direction transversely with respect to the longitudinal axis 9 of the metal profile 4, and/or in a direction of rotation about the longitudinal axis 9 of the metal profile 4.

Figure 2:
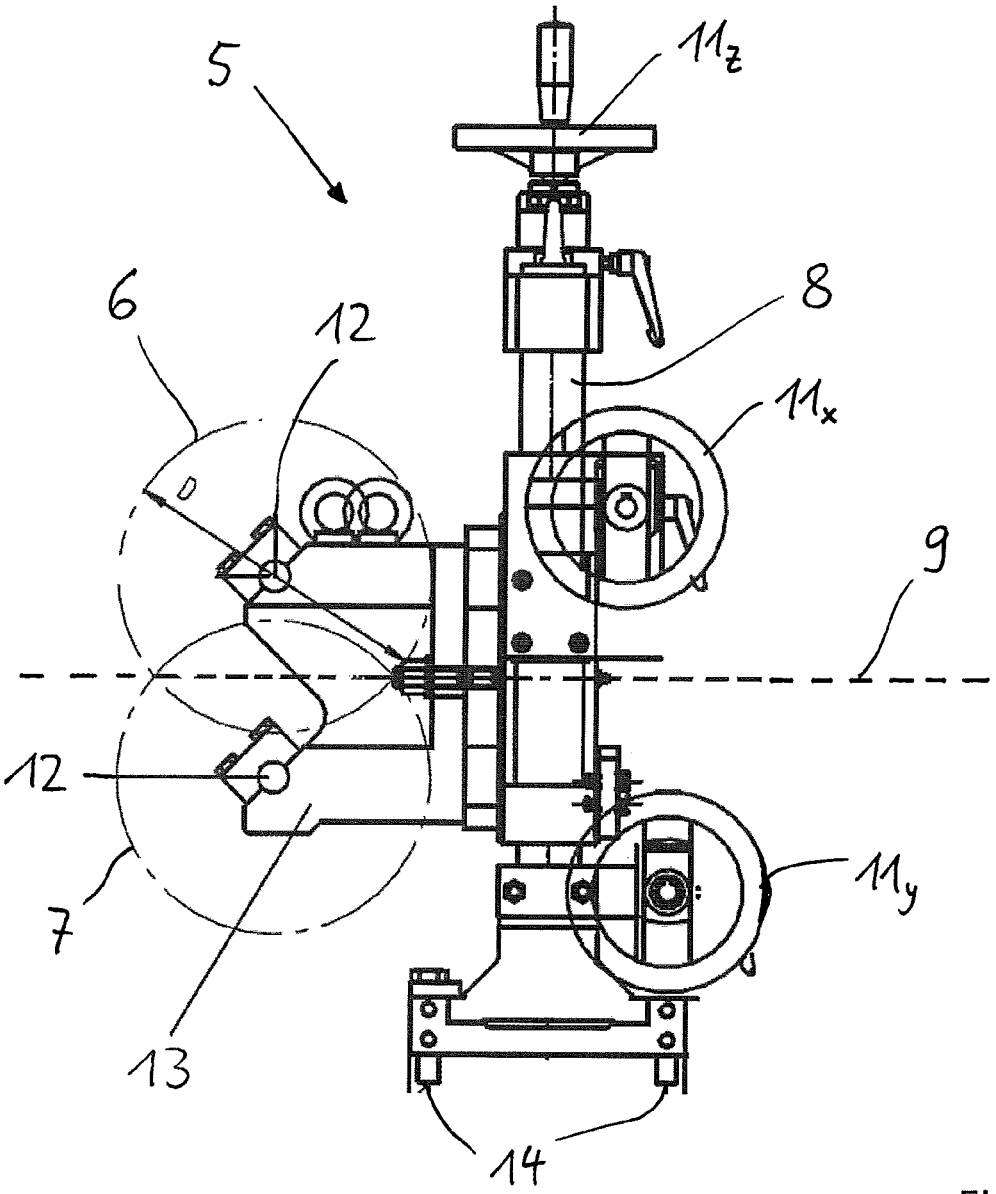
FIG. 2 shows an enlarged and lateral view of the removed profile straightening apparatus from FIG. 1.
Figure 3:
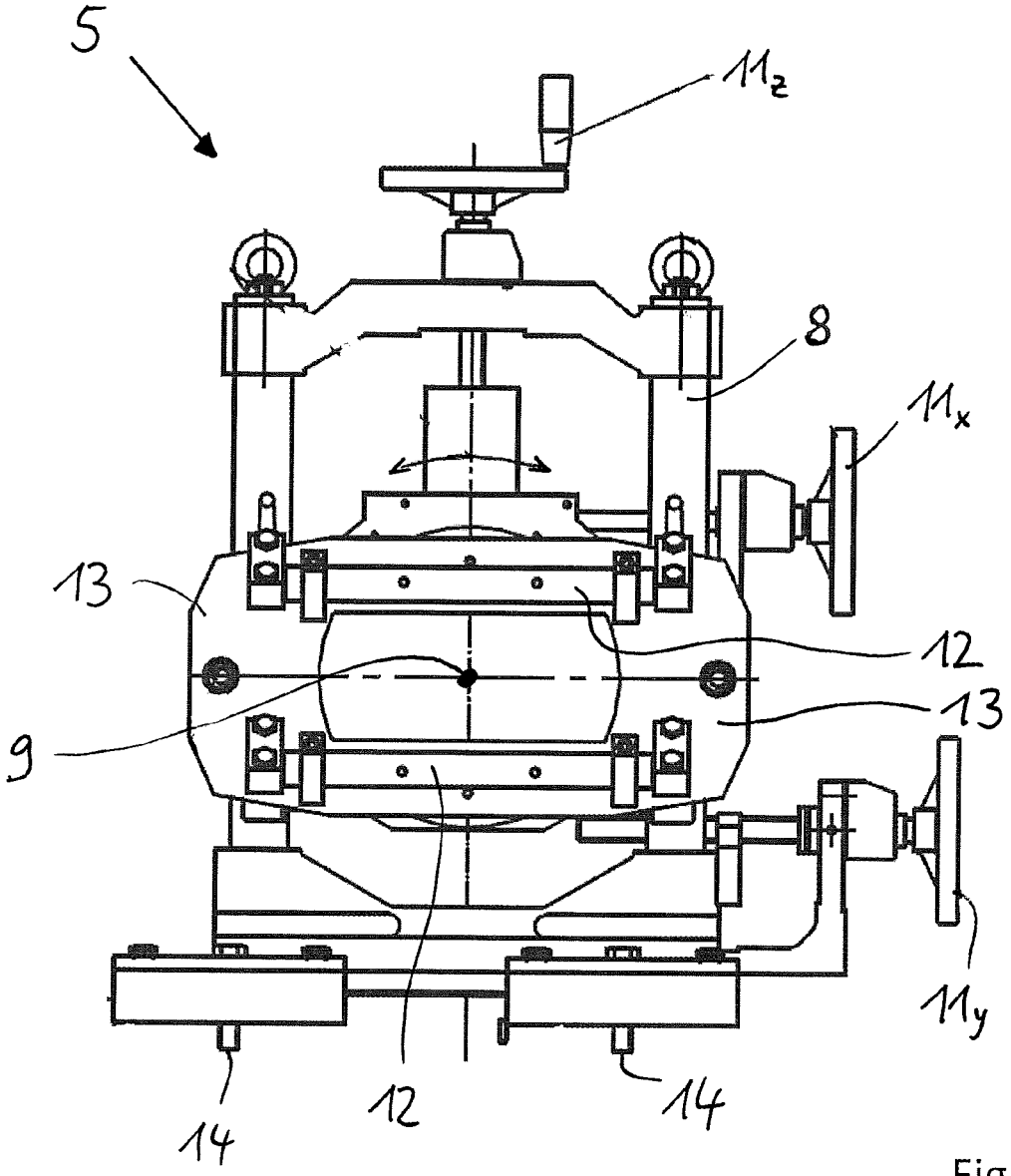
FIG. 3 shows the profile straightening apparatus from FIG. 2 in a view rotated through 90° about the horizontal axis.

FIGS. 2 and 3 illustrate the profile straightening apparatus 5 from FIG. 1 as such in an enlarged view, specifically in a lateral view (FIG. 2) and in a front view (FIG. 3) as seen in the direction of the longitudinal axis 9 of the metal profile 4.

The upper correction roller 6 and the lower correction roller 7 are configured in a profile-specific manner and therefore in the present case are only indicated by dash-dotted lines. In this way, correction roller axles 12 are visible, which are mounted with a mount 13 in the frame 8 in such a way that the relative position thereof to one another always remains constant. The adjustment drives 11 are symbolized by hand cranks, since the present invention is not limited to a motorized adjustment of the correction rollers, for example using a motor driven actuating screw. The adjustment drive $\mathbf{11}_z$ makes it possible to displace the mount 13 and thus the correction roller axles 12 collectively upward and downward; this is therefore a vertical adjustment. The adjustment drive $\mathbf{11}_y$ displaces the mount 13 or the correction roller axles 12 perpendicularly with respect to the longitudinal axis 9 of the metal profile 4 in a horizontal manner, and this is therefore a horizontal adjustment. With the adjustment drive $\mathbf{11}_x$, the mount 13 of the correction roller axles 12 is finally rotated as a whole about the longitudinal axis 9 in a clockwise or counter-clockwise direction, as a result of which a torsional adjustment is made.

By virtue of the fact that the profile straightening apparatus 5 is fixedly attached with fastening screws 14 to a substructure 15 (FIG. 1), and the metal profile 4 in the upstream forming station 1 is fixedly clamped in, a radial adjustment of the correction rollers 6, 7 by means of the vertical and/or horizontal adjustment drives $\mathbf{11}_z$, $\mathbf{11}_y$ makes it possible to introduce an axially proceeding bend into the metal profile 4 in order to compensate for any stresses which are present in the material and which would lead to an opposing bend and thus to an axial deviation from the prescribed profile geometry. In a corresponding manner, the adjustment drive $\mathbf{11}_x$ makes possible, in a direction of rotation, a torsion of the metal profile 4 in relation to the zero position defined in the forming station 1, as a result of which any twists of the metal profile 4 or internal stresses, which would lead to such twists, can be corrected.

Figure 4:
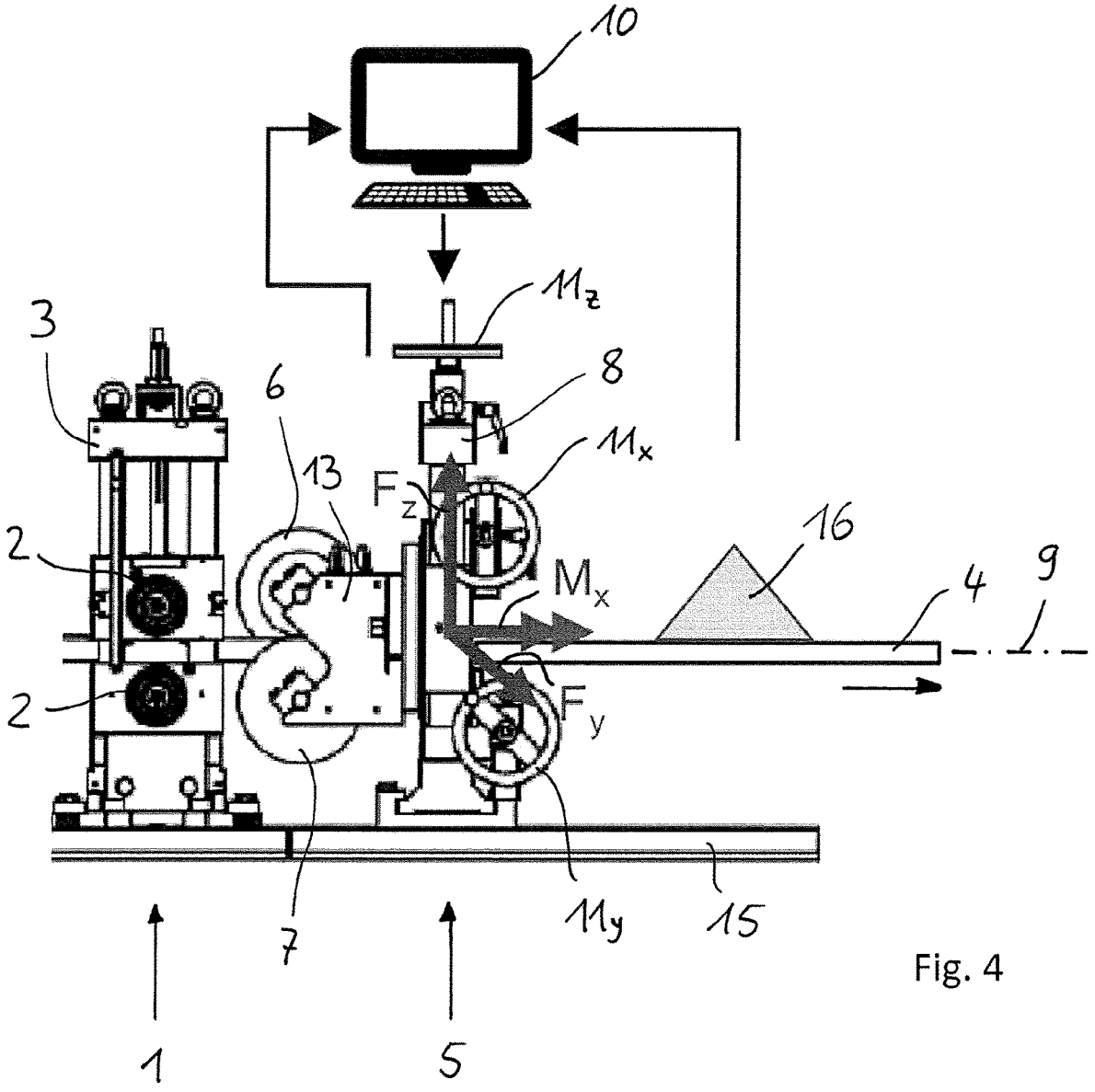
FIG. 4 shows a second exemplary embodiment of a profile straightening apparatus installed in a profiling system.

FIG. 4 shows a second exemplary embodiment of a profile straightening apparatus 5 according to the invention, with this exemplary embodiment differing from the exemplary embodiment according to FIG. 1 only by a measuring station 16 for the geometric measurement of the metal profile 4, said station being arranged downstream of the profile straightening apparatus 5. The measuring station 16 is expediently arranged at the output of the profiling system and is only indicated here, since there are already corresponding measuring devices for measuring the straightness of a profile. As is also indicated in FIG. 4, the measurement data of the measuring station 16 are also input into the controller 10 and taken into account by said controller during actuation of the adjustment drives 11.

The present exemplary embodiments are firstly intended to detect any forces $F_z$, $F_y$ acting in the two directions orthogonal to the longitudinal axis 9 of the metal profile 4 (vertically and horizontally), and also any torques $M_x$ about the longitudinal axis 9, and to output a warning in the case of changes during ongoing operation, since such changes in the forces or torques may be indicative of undesired axial deviations of the metal profile 4 from the prescribed profile geometry. Secondly, the exemplary embodiments implement a preferred configuration of the present invention, according to which the correction rollers 6, 7 or their correction roller axles 12 are adjustable in a motorized manner by means of adjustment drives 11 and can preferably be used already during set-up operation of the profiling system. To this end, as is illustrated in particular with reference to FIG. 1, the metal profile 4 is moved into the profile straightening apparatus 5 and possibly stopped there before it reaches downstream a separating machine (not illustrated here) for separating profile pieces. For the sake of completeness, it should be mentioned at this point that further machining stations right through to a feed of a second metal strip, a welding station or a number of further forming stations could also be connected downstream of the profile straightening apparatus 5.

By means of the force measuring sensors, it is then possible to ascertain any vertical and horizontal forces $F_z$, $F_y$, which are indicative of internal stresses which can lead to axial bowing. Said forces are expediently measured in the bearings of the correction roller axles 12, which are in line with the roll forming tools 2 of the forming station 1 which is last in the upstream direction. In a corresponding manner, a torque $M_x$ acting for instance on the correction rollers 6, 7 is also measured in the metal profile 4, said torque acting in a direction of rotation about the longitudinal axis 9 of the metal profile 4 and possibly leading to a torsion of the manufactured metal profile 4.

Any measured forces $F_z$, $F_y$ or torques $M_x$ are transmitted to the controller 10, in which a suitable algorithm is used to calculate from said measurement values how the correction rollers 6, 7 need to be adjusted vertically and/or horizontally and/or rotated about the longitudinal axis 9 of the metal profile 4 in order to neutralize the internal stresses acting in the metal profile 4 or counteract them such that undesired axial deviations from a prescribed profile geometry are corrected. The controller 10 uses the corresponding results to actuate the adjustment drives 11 of the profile straightening apparatus 5 and to adjust the correction rollers 6, 7 or their mount 13 correspondingly.

Even if, during set-up operation of the profiling system, the profile straightening apparatus 5 is conventionally set by hand in order to manufacture profile pieces without axial deviations from the intended profile geometry, the motorized adjustability of the correction rollers 6, 7 improves the further operation of the profiling system. In this case, changes in the measured forces $F_y$, $F_z$ or torques $M_x$ are transmitted to the controller 10, in which a suitable algorithm is used to calculate how the correction rollers 6, 7 need to be further adjusted vertically and/or horizontally and/or rotated about the longitudinal axis 9 of the metal profile 4 in order to neutralize the changed internal stresses acting in the metal profile 4 or counteract them such that undesired axial deviations from a prescribed profile geometry are corrected. The controller 10 uses the corresponding results to actuate the adjustment drives 11 of the profile straightening apparatus 5 and to adjust the correction rollers 6, 7 or their mount 13 correspondingly.

In both exemplary embodiments, axial deviations of the metal profile 4 from the prescribed profile geometry are thus already corrected at the output of the forming station 1, with there being no dead time between the identification of causes for axial shape deviations and the correction of same; therefore no waste is produced.

The modified exemplary embodiment according to FIG. 4 can optimize the method just described in that the profile geometry is measured downstream of the profile straightening apparatus 5 by means of the measuring station 16, which is merely indicated. Expediently, this happens at the very end of the profiling system, after the metal profile 4 has been separated into individual profile pieces. In this way, it is possible to identify, if, in spite of correction, axial deviations of the metal profile 4 from the prescribed profile geometry are still present, therefore the algorithm of the controller 10 has not led to the optimal correction result. The measurement values of the measuring station 16 are likewise fed back into the controller 10 and taken into account there by the algorithm, in that either the calculation is corrected in a case-specific manner or the algorithm is continually optimized.

The invention claimed is:

1. A method for correcting axial deviations of a metal profile (4) from a prescribed profile geometry in a profiling system which is used to produce the metal profile (4) by roll profiling along a longitudinal axis (9) of the metal profile (4), using a profile straightening apparatus (5) including at least two interacting correction rollers (6, 7) mounted to a frame (8), the at least two interacting correction rollers (6, 7) being adjustable in at least two radial directions and also in at least one direction of rotation, and force measuring sensors adapted to detect forces (Fy, Fz) acting on the metal profile (4) in the radial directions and for any torques (Mx) acting on the metal profile (4) in a direction of rotation about the longitudinal axis (9), the method comprising:

moving the metal profile (4) into the profile straightening apparatus (5), which is integrated in the profiling system or is connected downstream thereof, ascertaining, before the metal profile (4) reaches a downstream machining station, at least one of any radial forces (Fy, Fz) acting on the metal profile (4) in the profile straightening apparatus (5) or any torques (Mx) using the force measuring sensors, and calculating adjustment values for an adjustment of the correction rollers (6, 7) in at least one of the radial directions or the direction of rotation from the at least one of the radial forces or torques to be used for the correction rollers (6, 7) in order to correct axial deviations of the metal profile (4) from the prescribed profile geometry.

2. A method for correcting axial deviations of a metal profile (4) from a prescribed profile geometry in a profiling system which is used to produce the metal profile (4) by roll profiling along a longitudinal axis (9) of the metal profile (4), using a profile straightening apparatus (5) including at least two interacting correction rollers (6, 7) mounted to a frame (8), the at least two interacting correction rollers (6, 7) being adjustable in at least two radial directions and also in at least one direction of rotation, and force measuring sensors adapted to detect forces (Fy, Fz) acting on the metal profile (4) in the radial directions and for any torques (Mx) acting on the metal profile (4) in a direction of rotation about the longitudinal axis (9), the method comprising:

ascertaining at least one of any radial forces (Fy, Fz) acting on the metal profile (4) in the profile straightening apparatus (5) or any torques (Mx) using the force measuring sensors, inputting at least one of the ascertained forces (Fy, Fz) or torques (Mx) into a controller (10), the controller (10) calculating adjustment values therefrom for an adjustment of the correction rollers (6, 7) in at least one of the radial directions or the direction of rotation, and outputting the adjustment values as recommended actions for adjustment of the correction rollers (6, 7).

3. The method according to claim 2, wherein the force measuring sensors input the at least one of the ascertained forces (Fy, Fz) or the torques (Mx) into the controller (10), the controller (10) calculates the adjustment values therefrom for the adjustment of the correction rollers (6, 7) in at least one of the radial directions or in the direction of rotation and actuates adjustment drives of the profile straightening apparatus in order to adjust the correction rollers (6, 7) in accordance with the adjustment values.

4. The method according to claim 3, wherein the metal profile (4) is moved into the profile straightening apparatus (5), which is integrated in the profiling system or is connected downstream thereof, and, before the metal profile (4) reaches a machining station arranged downstream of the profile straightening apparatus (5), the at least one of any radial forces (Fy, Fz) acting on the metal profile (4) in the profile straightening apparatus (5) or the any torques (Mx) are ascertained by the force measuring sensors, and the adjustment values for the adjustment of the correction rollers (6, 7) in at least one of the radial directions or the direction of rotation are calculated therefrom, to be used for the correction rollers (6, 7) to be adjusted in order to correct axial deviations of the metal profile (4) from the prescribed profile geometry.

5. The method according to claim 3, wherein the profile straightening apparatus (5) includes a measuring station (16) arranged downstream of the correction rollers (6, 7) with respect to the direction of movement of the metal profile (4), the measuring station being configured for geometric measurement of the metal profile (4) and being operatively connected to the controller (10), and the method includes checking the calculated adjustment value based on geometric measurement data of the measuring station (16) and upon detecting deviations providing corresponding correction values for calculation the adjustment values.

6. The method according to claim 2, wherein the adjustment values are output as recommended actions for operating personnel to adjust the correction rollers (6, 7) through manual adjustment.

7. The method according to claim 2, further comprising outputting an alarm signal, from an alarm of the profile straightening apparatus, if a magnitude of the forces ($F_y$, $F_z$) or torques ($M_x$) ascertained by the force measuring sensors change beyond a prescribed threshold value.

8. The method according to claim 3, further comprising adjusting the correction rollers (6, 7) using motorized adjustment drives ($\mathbf{11}_x$, $\mathbf{11}_y$, $\mathbf{11}_z$) of the profile straightening apparatus, wherein the adjustment drives ($\mathbf{11}_x$, $\mathbf{11}_y$, $\mathbf{11}_z$) are operatively connected to the controller (10) which is operatively connected to the force measuring sensors.

9. The method according to claim 2, wherein the correction rollers (6, 7) are adjustable while maintaining positions thereof assumed relative to one another.

10. The method according to claim 2, wherein the correction rollers (6, 7) are adjustable in two radial directions orthogonal to each other, and also in the direction of rotation.

11. The method according to claim 2, further comprising guiding the metal profile (4) through the frame (8) using guide rollers mounted in the frame (8), the guide rollers being mounted at least one of upstream or downstream of the correction rollers (6, 7) in relation to a direction of movement of the metal profile (4).

12. The method according to claim 11, wherein the force measuring sensors are at least partially arranged in a region of the guide rollers.

13. The method according to claim 2, wherein the force measuring sensors are at least partially arranged on at least one of the correction rollers (6, 7), axles (12) of the correction rollers, bearings of the correction rollers in the frame (8), or on an adjustment mechanism for the correction rollers (6, 7).

14. The method according to claim 8, wherein the profile straightening apparatus (5) includes a measuring station (16) arranged downstream of the correction rollers (6, 7) with respect to the direction of movement of the metal profile (4), the measuring station being configured for geometric measurement of the metal profile (4) and being operatively connected to the controller (10), and the method includes checking the calculated adjustment value based on geometric measurement data of the measuring station (16) and upon detecting deviations providing corresponding correction values for calculation of the adjustment values.

15. The method according to claim 14, further comprising combining, by the controller (10), the geometric measurement data obtained by the measuring station (16) with magnitudes of at least one of the forces ($F_y$, $F_z$) or the torques ($M_x$) ascertained by the force measuring sensors in order to identify relationships between the ascertained magnitudes of the forces ($F_y$, $F_z$) and torques ($M_x$) and the geometric measurement data of a same profile portion, and also relationships between changes in the ascertained magnitudes of the forces ($F_y$, $F_z$) and the torques ($M_x$) and changes in the geometric measurement data of the same profile portion, and utilizing said relationships for control of the adjustment drives ($\mathbf{11}_x$, $\mathbf{11}_y$, $\mathbf{11}_z$).

* * * * *